US005996386A

United States Patent [19]

Pazzaglia

[11] Patent Number: 5,996,386

[45] **Date of Patent: *Dec. 7, 1999**

[54] EQUIPMENT AND METHOD FOR EDGING AND TAPERING CYLINDRICAL BODY CANS

[76] Inventor: Luigi Pazzaglia, Via Bellacosta, 28 - 40137 Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,874

[22] Filed: Sep. 23, 1997

Related U.S. Application Data

[63] Continuation-in-part of application No. 08/790,681, Jan. 28, 1997, abandoned.

[30] Foreign Application Priority Data

Apr. 21, 1994 [IT] Italy ..... BO94A0172

[51] Int. Cl.[6] ..... B21D 19/04

[52] U.S. Cl. ..... 72/84; 72/111

[58] Field of Search ..... 72/67, 74, 84, 72/85, 94, 110, 111

[56] References Cited

U.S. PATENT DOCUMENTS 3,610,009 10/1971 Franek ..... 72/94
3,690,278 9/1972 Rautavalta ..... 72/74
4,134,284 1/1979 Nitschke ..... 72/84

FOREIGN PATENT DOCUMENTS 690890 5/1940 Germany ..... 72/84

*Primary Examiner*—Lowell A. Larson
*Attorney, Agent, or Firm*—Dvorak & Orum

[57] ABSTRACT

The edging or tapering equipment requires that each of the two shaped pads, for the plastic deformation of the two edges of a respective can body, be positioned so that the longitudinal axis of the pads lies at an angle to the longitudinal axis of the can body located in an operating position zone, and that the pads be set at opposite angles to one another; each of these shaped pads also moves independently, rotating and traversing around and along their respective longitudinal axis and simultaneously traversing along a determined longitudinal axis so as to obtain, at an operating contact position, induced rotation of the can body in a direction concording with the rotation of the shaped pads and designed to allow contact between each operating head and the respective edge in a zone for the definition of the profile of said edge, a profile which is created gradually, by simultaneous linear traversing and rotation of the shaped pads along the axis.

10 Claims, 5 Drawing Sheets

EQUIPMENT AND METHOD FOR EDGING AND TAPERING CYLINDRICAL BODY CANS

This application is a continuation-in-part of application Ser. No. 08/790,681 filed Jan. 28, 1997, now abandoned.

BACKGROUND OF THE INVENTION

The present invention concerns an equipment for the conveying, edging or tapering of at least one edge of body cans, in particular but not exclusively cylindrical body metal cans, made by sealing their respective overlapping longitudinal edges or by drawing and re-drawing, and the method for conveying and edging or tapering one or both of the two edges of the respective can body.

In the metal cylindrical body can production sector (products normally used for foodstuffs, preserves and drinks), one of the most delicate stages is the definition of the circular edges of can bodies; these edges must, in fact, be "deformed" so that, in the first instance, they have an arched profile with diameter larger than the diameter of the cylindrical section of the can body; (the said operation is called edging), alternatively, an inward narrowing of the edge towards the internal surface of the said body (this operation is called tapering).

To obtain these edge shapes, machines equipped for the corresponding plastic deformation techniques are used, the equipment selected in accordance with the dimensions of the can bodies to be worked: for edging the respective two edges of can bodies, either a pair of opposing shaped pads or a or a pair opposing rotating heads with numerous shaped pads or a or a pair opposing rotating heads with numerous shaped rollers are used, whilst for tapering, traversing shaped pads only are used, described in further detail below.

Machines which use such equipment generally have a can body feeder station which supplies them to an individual can body pick-up station, also used to position the can body at an edging station. This station consists of traversing shaped pads or traversing-rotating heads with rollers: the case examined herein concerns the first of these two types of equipment.

The said equipment consists of two cylindrical operating heads, positioned opposite one another, each with a shaped pad whose profile defines the 'negative" of the profile to be created on the edge if the can body; each operating head is supported by a respective shaft which moves along longitudinal axis so that the two operating heads can be moved towards and away from each other. For tapering, an internal pad is employed, with axial movement relative to the operating head, and which determines the extent to which the external edge is tapered, and facilitates removal of the can body from the relative shaped pads.

In practice, the can body is, therefore, placed between the two shaped pads, its longitudinal axis placed coaxially to the pads' traversing axis; the shaped pads are then moved towards the can body, fixed in the said position, until they gradually make contact with the respective edges of the can body with enough force to obtain the desired plastic deformation of the edges when the two shaped pads reach the limit or their forward travel This "pad" edging or tapering technique, however, limits the diameter and thickness of the can body, since the force necessary to obtain plastic deformation of the can body edges, being simultaneously distributed on the entire edge circumference, is greater than that applied using the traversing and rotating rollers which, in contrast, cause "punctiform" deformation of the edge surface; pad edging, for example, is carried out on cans with a larger diameter which, if they are of suitable thickness, bear the force applied to the entire end without problems. As well as this size limitation, it has been observed that, during pad edging, and especially where can bodies have reduced diameter and thickness, buckling or abnormal plastic deformation may occur on the edge where the edge joins the aforementioned can body longitudinal edges.

SUMMARY OF THE INVENTION

The main aim of the present invention is, therefore, to eliminate the afore-mentioned problems by the creation of shaped pad equipment and the relative method for edging or tapering can bodies, with a simple, economical architecture, and which can be used to effect precision deformation of one or both of the two edges of can bodies or any shape, size, and thickness.

A further main aim of the present invention is to provide an equipment method of the afore mentioned type which can be applied in a machine with high automation.

BRIEF DESCRIPTION OF THE DRAWINGS

The technical specifications of this invention, in accordance with the afore-mentioned main aims, are clearly described in the claims herein, and the advantages of the invention are described in more detail below, with the aid of the accompanying drawings, which illustrate an embodiment by way of example only, and in which:

DESCRIPTION OF THE PREFERRED EMBODIMENT

With reference of the accompanying drawings, the equipment which is the object of this invention and the method created using said equipment, has been specially designed for use on machines which edge or taper body cans 1 (formed by sealing the two longitudinal edges, that is to say, cans with three components; or formed by drawing and re-drawing, that is to say, cans made up of the two components), in a particular cylindrical body cans 1 which extend along a longitudinal axis X, and having, in the case of three-component cans, two opposite open ends; to facilitate understanding, in the following description, the term plastic deformation is used reference to edges to edges 2 in general, since the equipment and method can be used in both operations (edging or tapering) for the plastic deformation of at least one of the two edges 2, by simply modifying the pads and adding an internal system which determines the tapering of the ends, and which can also be used as a system for removal of the can body.

Figure 1:
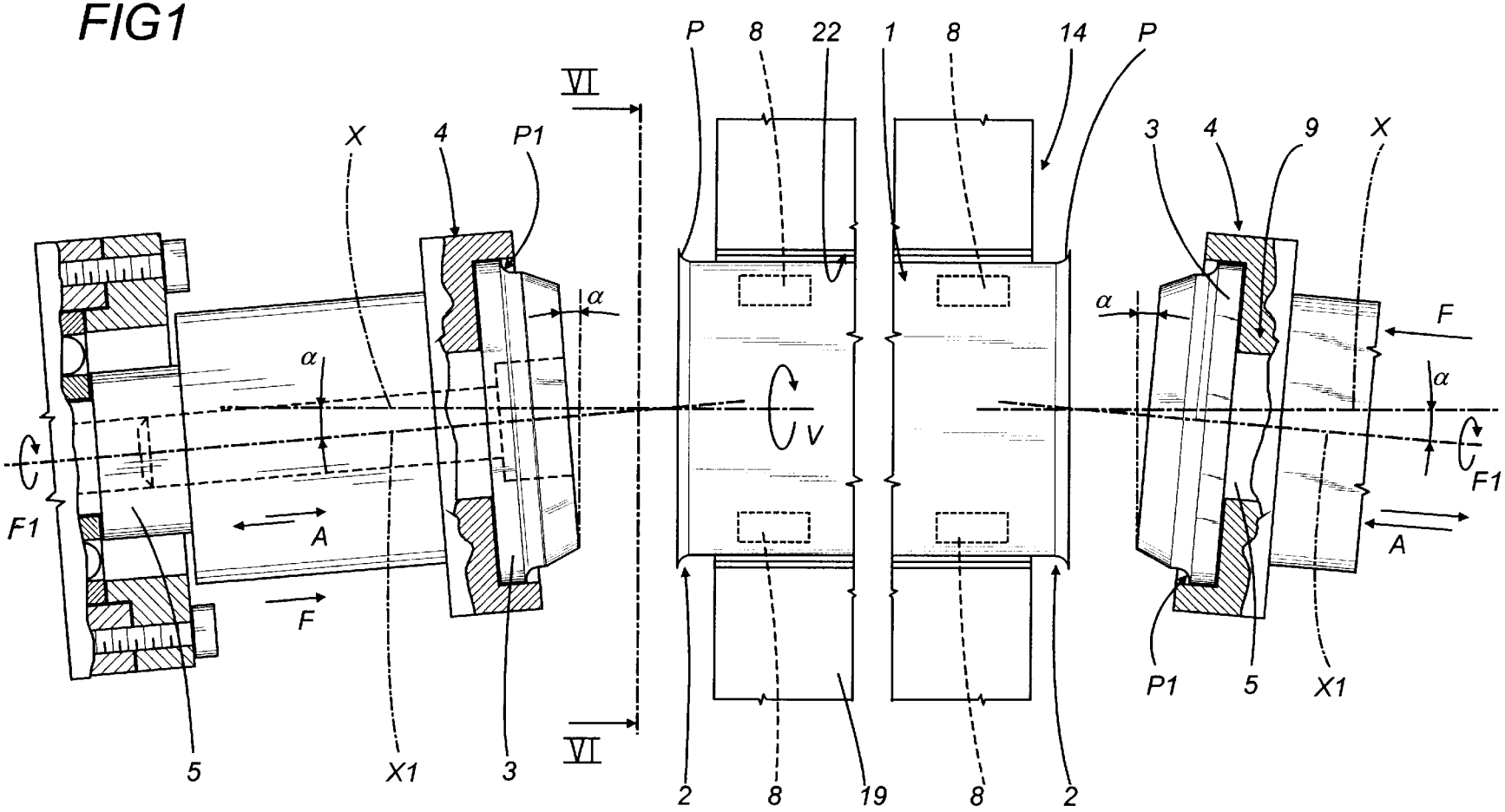
FIG. 1 is a side view of the equipment for edging two edges of cylindrical body cans, according to this invention, with some parts cut away to better views others.

The equipment according of FIG. 1 consists of a pair of operating heads 3, designed to allow the actual plastic deformation of the profile P of the two edges 2; the said operating heads 3 are located on opposite sides of an operating position zone in which the can body 1 to be edged is positioned.

As shown particularly in FIG. 1, which refers to the edging operation of two edges 2 of the can body 1, each of the operating heads 3 includes is respective cylindrical part of pad 4 with a profile P1 which reflects the aforementioned profile P to be created on the two edges 2 of the can body 1, and whose external dimension reflects the circumference of the can body 1. Each operating head 3 is integral with respective driving means 5 (for example, a shaft), which can turn about or travel along a longitudinal axis X1 between two extremes: one non-operative, in which the shaped pads 4 are distant from the respective edge 2, and the other operative, in which the shaped pads 4 gradually come into contact with the relative edge 2 with a force, indicated by the arrow F, that allows plastic deformation of the edge 2 caused by the simultaneous forward movement and rotation of the pads 4.

Figure 3:
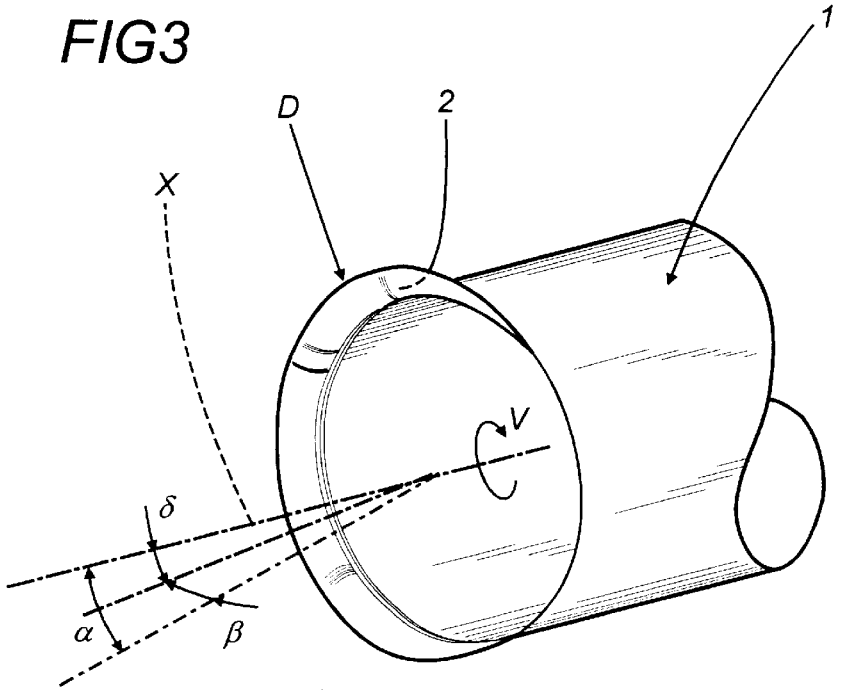
FIG. 3 is an enlarged perspective front view of a can body, on whose edge the edging operation is carried out, with some parts cut away.
Figure 6:
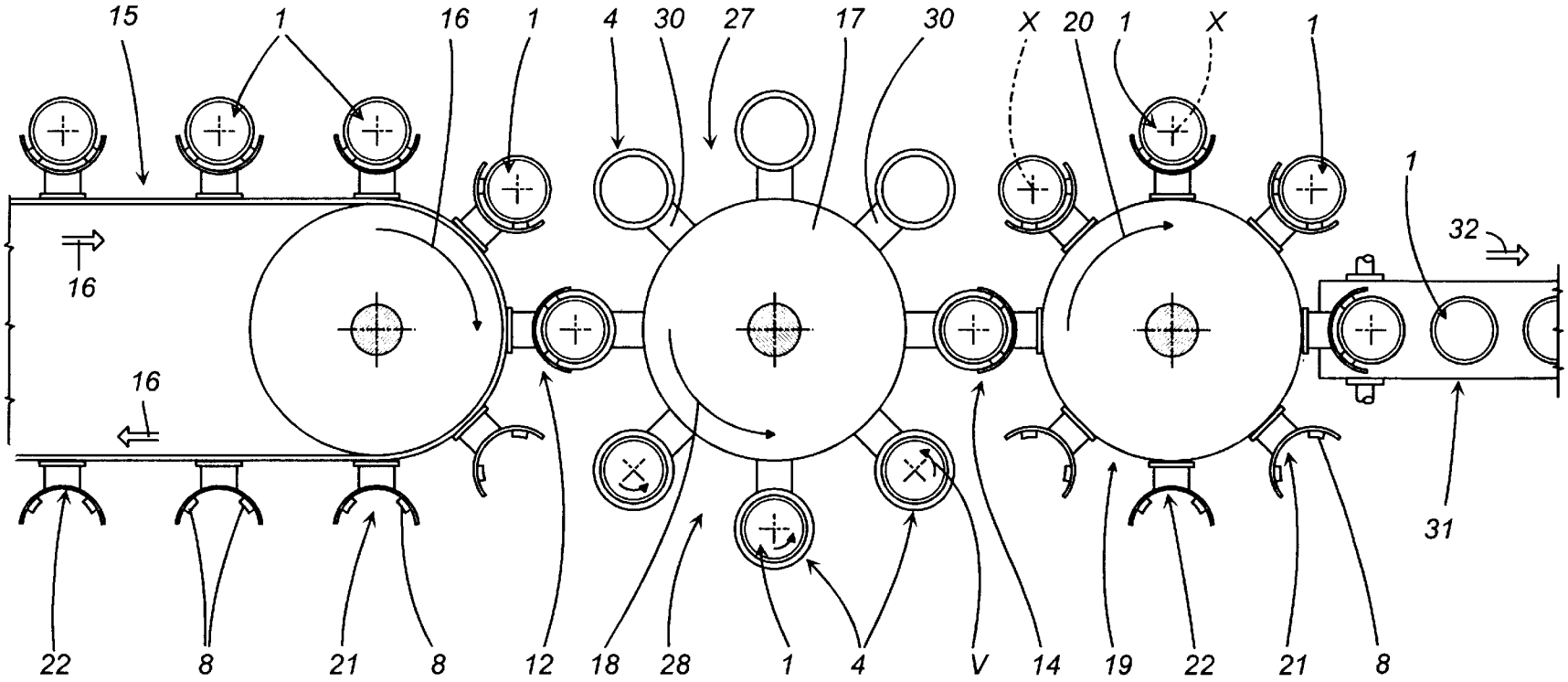
FIG. 6 is a scaled down and schematic top view of the embodiment of the equipment illustrated in FIG. 1 according to the line VI—VI, the equipment being integrated in a machine of high automation with two alternative types of feeding means.

In this case, the longitudinal axis X1 of each of the shaped pads 4 must be set at an angle $\alpha$ to the longitudinal axis X of the can body 1, positioned in the said operating position zone at the same angle to the vertical plan (see also FIG. 6); This angle $\alpha$ between the axis of the shaped pad 4 and the longitudinal axis X of the can body is composed of two components, a first subangle $\delta$ in a first longitudinal plane, in the case as illustrated in FIG. 3 in a vertical plane, an a second subangle $\beta$ in a second longitudinal plane which is perpendicular to said first longitudinal plane, in the case of FIG. 3 in a horizontal plane. Said two components define the afore-mentioned angle $\alpha$ of the pads 4.

The pads 4 are also set at opposite angles to one another, i.e. the two angled pads 4 define a sharp angle less than 180° between themselves, and said two pads 4 are able to traverse independently, as indicated by arrow A, and to rotate, as indicated by arrow F1, around their respective longitudinal axes X1 simultaneously: when the linear forward movement of the two opposed pads 4 brings them into the operating position, this rotation allows induced rotation of the can body 1 in the same direction V as the rotation of the pads 4, obtained by the contact between each operating head 3 and the corresponding edge 2 in the zone indicated by the letter D in FIG. 3, which produces the gradual definition of the two edge profile P (illustrated in FIG. 1).

The afore-mentioned angle $\alpha$ between the longitudinal axis X1 of each pad 4 and the longitudinal axis X of the can body 1 ranges between 0 and 30° and, preferably, but not necessarily, said angle $\alpha$ will be between 0.5 and 5° (greater angles $\alpha$ are used in the figures, in order to better illustrate the solution).

Figure 2:
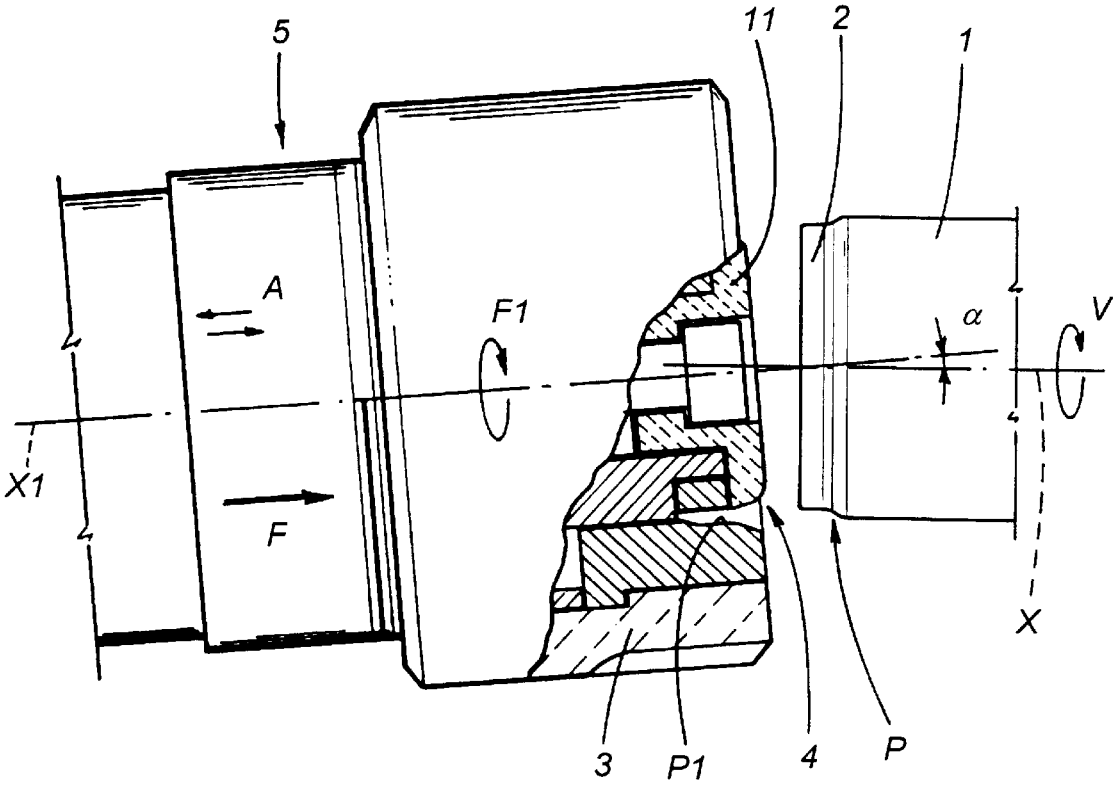
FIG. 2 is an enlarged side view of a detail of equipment for the tapering of cylindrical body cans, with some parts cut away.
Figure 2A:
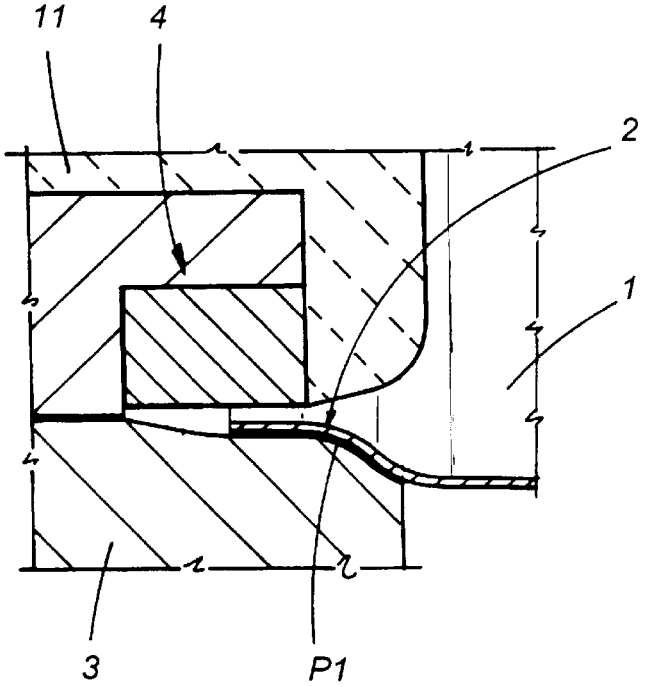
FIG. 2*a* is an enlarged side view of a detail of equipment illustrated in FIG. 2 during the initial stage of tapering.

FIGS. 2 and 2*a* provide a good illustration of part of the equipment for tapering the edges 2 of can bodies 1 with the structure described above, where an operating head 3 partially covers the outside of the edge 2 of the can body 1, gradually operating in the said zone d, and where an internal pad 11 determines the deformation of the end section of the edge 2 during tapering, then removes the can body 1 by performing a further linear forward movement. Again in this case the can body 1 is able to rotate about its own axis X.

The operating method and equipment described above for edging or tapering cylindrical body cans 1, therefore, requires an initial stage in which the can body 1 is positioned in the operating zone; the driving means 5 then move the two shaped pads 4 towards the relative edges 2 (see arrows A and F1 in FIGS. 1 and 2), the pads traversing and rotating simultaneously. Finally, contact occurs in zone D between the pads 4, still traversing and rotating, and the edges 2, allowing gradual plastic deformation of the edges 2 during induced rotation of the can body 1 (see arrow V in FIGS. 1 and 2). It is then possible to precisely determine the size of the edged or tapered ends of the can bodies 1 through a series of further rotations of the pads 4, when the driving means 5 have terminated their travel A towards the can bodies 1. In the case of tapering, unit 11 call effect a further travel towards the can body 1, after tapering, to remove it from the pads 4.

The above text describes equipment which can be used to edge and taper two edges of cylindrical body cans 1 positioned so that the said longitudinal axis X lies horizontally, yet it is also possible to carry out the said operations with the same equipment when the longitudinal axes X of the can bodies 1 are positioned vertically; in this case, the aforementioned angles $\alpha$ of the shaped pads 4 are calculated and referred to the vertical axis.

Figure 4:
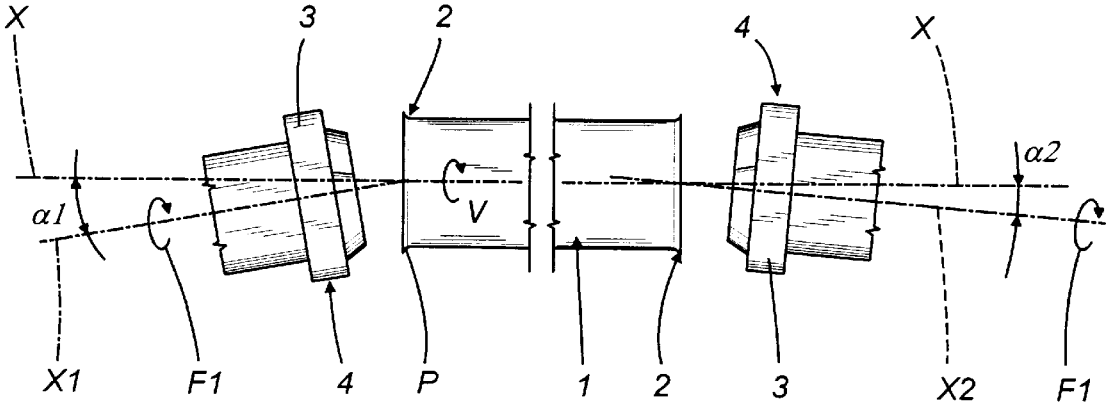
FIG. 4 is a scaled down side view of another embodiment of the equipment illustrated in the afore-mentioned figures.

Another embodiment is shown in FIG. 4, where the shaped pads 4 are set, on their corresponding axes X1 and X2, at the respective angles al and a2, which are not the same, again with respect to the longitudinal axis X of the can body 1; the shaped pads 4 can traverse and rotate on these angled axes X1 and X2, as described previously, in a synchronized fashion.

The said equipment and relative method, therefore, allow optimum working to be obtained on the two edges 2, with minimum; alterations to the architecture of the pads 4 whether they are used for edging or tapering; the fact that contact is made on a relatively narrow zone, due to the gradual traversing and rotation of the pads 4, means that can bodies 1 of any size or thickness can be worked without the risk of abnormal deformation, or in any case, buckling on the two 2 to be worked.

Figure 5:
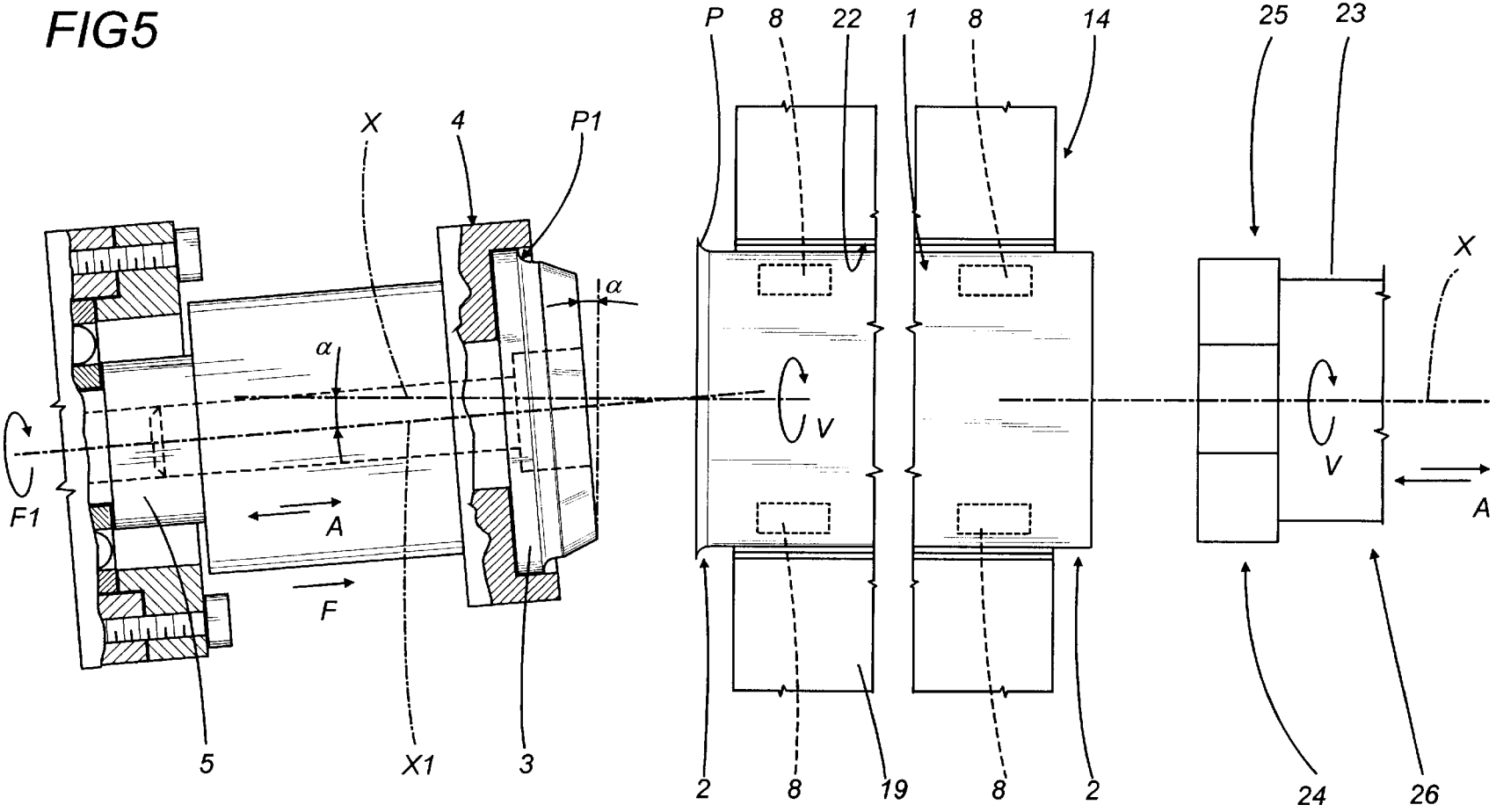
FIG. 5 is a side view of the equipment for edging only one edge of cylindrical body cans, according to this invention, with some parts cut away to better view others.

According to a further embodiment, the equipment as shown in FIG. 5 consists of only one operating head 3, which corresponds to one of the two operating heads 3 of FIG. 1 and which is designed to allow the actual plastic deformation of the profile P of one of the two edges 2 of the can body 1. The second operating head 3 of FIG. 1 has been replaced in FIG. 5 by a supporting head 23 which is preferably coaxial to the can body 1 and provided with driving means, not illustrated, in order to be able to rotate around the can body axis X in the direction V and to traverse independently in a direction as indicated by arrow A which is preferably coaxial or parallel to the longitudinal axis X of the can body 1 on the second edge 2, i.e. the edge which has been worked, in order to ensure the positioning of the can body 1 in the operating position, but without deforming plasmically said second edge 2 of the can body 1.

In particular, the supporting head 23 is provided with a circular portion 24 with an outer annular surface 25, for example a cylindrical surface 25, having a diameter and longitudinal dimension such as to be able to support circularly the hollow can body 1 at said second edge 2 on the internal surface thereof, not illustrated.

According to a not illustrated embodiment, the circular portion 24 could for example consist of a plurality of independent and circumferentially arranged single components which form together the circular portion 24 and which are able to be moved by suitable operations means, not illustrated, radially toward, or away from the internal surface of the hollow can body 1 in order to support or release said can body 1 at said second edge 2.

Said outer surface 25 of the supporting head 23 protrudes radially over the outer and adjacent surface 26 of said supporting head 23 in order to prevent an axial abutment of said second edge 2 when the portioning 24 of the supporting head 23 should be inserted in the hollow can body 1 more as it would be necessary.

Relating to FIG. 6, which is a scaled down top view of the embodiment of the equipment of FIG. 1 according to line V1—V1, it is illustrated the equipment according to the present invention being integrated in a machine of high automation, from which there are only shown two feeders 15 and 19.

But there is also the possibility to provide the automatic machine as in part illustrated in FIG. 6, with the equipment of FIG. 5, i.e. with an equipment for deforming only one of the two edges 2 of the can body 1. In this case the pads 4 shown in FIG. 6 must only be replaced by the above-mentioned supporting head 23, respectively.

Referring always to FIG. 6, there are illustrated two types of feeders, i.e. the first can body feeder, conveyor belt 15 and the second can body feeder, a turnable 19 which is operatively connected with a further conveyor belt 31 moving in the direction indicated with 32. However, the feeders 15 and 19 can be of any type suitable for conveying the can bodies 1.

The first can body feeder 15 moving in a direction indicated with 16 is able to convey unworked body cans 1 in relative semi-circular seats 21 to a pick-up station 12. A circular operating feeder means 17, being rotable in a direction as indicated with arrow 18, is provided with a plurality of the aforementioned opposed operating heads 3, preferably arranged according to FIG. 1, or with a plurality of a respective operating head 3 and an opposed supporting head 23, preferably arranged according to FIG. 5, which are uniformly distributed on the circumference of said operating feeder means 17 and supported, controlled and activated by activation means 30, not illustrated in detail. The opposed heads 3, 23 are able to traverse at the supply station 12 according to arrow A (see also FIGS. 1 or 5) from a non-operating and distanced position into an operating or contact position which relates to the can body 1 to be worked in order to permit an automatic supporting of said can body 1 to be worked between said heads 3, 23. Furthermore, the opposed heads 3, 23 are able to traverse at a takeover station 14 according to arrow A (see also FIGS. 1 or 5 from said operating or contract position into said non-operating or distanced position with relates to the already worked can body 1, in order to permit an automatic release of said worked can body 1 from the opposed heads 3, 23, and to allow simultaneously an automatic fixing of the same can body 1 in a relative seat 21 of a second can body feeder 19 moving in a direction as indicated by arrow 20.

In particular, each seat 21 of said first and second can body feeder 15, 19 is provided with at least one radial fixing means 8, and according to the preferred embodiment of the present invention with for example four magnets 8 (see also FIGS. 1 or 5), with which the outer, in the present case cylindrical surface of the metal can body 1 comes in contact. The magnets 8 preferably protrude from the seat surface 22, in correspondence to the can body 1 also cylindrical, so that the respective magnetically fixed can body 1 does only come into contact with said magnets 8 at predetermined points and not with the seat surface 22 in order to prevent that the outer surface of the can body 1 could be damaged in the seat 21.

The can bodies 1 supported by the magnets 8 in a relative seat 21 of the first or second can body feeder 15 or 19 do not rotate around their longitudinal axis X, but will be conveyed in a direction as indicated by arrow 16 or 20. When the can bodies 1 are located between and supported by the opposed operating heads 3, 23, (see FIG. 1), or by the opposed operating head 3 and supporting head 23 (see FIG. 5), and consequently removed from the magnets 8 of the seats 21, said can bodies 1 will respectively rotate around their longitudinal axis X in the direction V according to the rotational movement of the heads 3, 23.

So, each can body 1 will be rotated by the heads 3, 23 about their longitudinal axis X in the direction V and will be simultaneously fed by the circular operating feeder means 17 from the supply station 12 to the take-over station 14 in the direction 18, when the heads 3, 23, are in said operating or contact position, as it is case in the operating zone generally indicated in FIG. 6 with 28. Furthermore, in the zone generally indicated with 27 of the circular operating feeder means 17, i.e. the zone where no can body 1 is positioned between the heads 3, 23, the same heads 3, 23 have automatically assumed the non-operating or distanced position. In this manner there is no possibility that one or both heads 3, 23 could come in collision with the can body 1 at the supply station 12.

The functioning of the equipment according to the present invention can be automatically regulated and/or commanded by a central control system, not illustrated. In particular, the distance between the heads 3, 23, and the operating force F on the edges 2 can be automatically varied for different types of can bodies 1 to be worked.

The equipment according to the present invention permits advantageously an automatic, quick and safe fixing, supporting, conveying and working of can bodies which could also have a different shape, size, and thickness.

According to the equipment and method of the illustrated embodiments, the respective can body 1 will be continuously conveyed by the first feeder 15, the circular operating feeder means 17 and the second feeder 19 without any feeding interruption.

The transition of the respective can body 1 at the supply station 12 and the takeover station 14 occurs automatically in a quick and reliable manner by the cooperation of the at least one fixing means 8 and the heads 3, 23 which traverse from a non-operating position to a operating position at the supply station 12 and from an operating position to a non-operating position at the take-over station 14.

The fixing means 8 for the can body 1 are preferably arranged in a central zone of the can body 1, or at least in zone with a sufficient distance to both of the two edges 2 in order to permit the opposed head 3, 23, to come undisturbed into contact with said two edges 2.

According to further and not illustrated embodiments of the present invention, it is also possible that one or both operating heads traverse independently in a direction which is parallel to the longitudinal axis X of the body can 1. According to another embodiment, it could be possible that the supporting head 23 traverses in a direction which is not exactly parallel to the longitudinal axis X of the body can 1, i.e. in a direction with an angle $\alpha$ to said longitudinal axis X.

Furthermore, the can body 1 to be worked with the equipment according to the present invention can advantageously be of cylindrical shape or of an other shape which is able to be tapered or edged.

In case of non-magnetic can body material the aforementioned fixing means 8 can for example be of pneumatic suction type, not illustrated.

The afore-mentioned seats 21 are preferably of semicircular and cylindrical shape, but can also be of any other shape, in correspondence to the external shape of the can body 1, which permits a secure fixing, feeding and transition at the supply station 12 and the take-over station 14 of the respective can body 1.

Finally, according to a further an non-illustrated embodiment of the present invention it is also possible to deform plasmically one edge of a can body having only one open end, i.e. a can body being closed at its other end, not illustrated. In this case, the supporting head according to FIG. 5 has to be adequately modified, for example by using a system, not shown, which is able to clamp circularly the can body on its external longitudinal surface at said closed end with out deforming plasmically said an body. Said system could for example consist of a circular portion formed by a plurality of independent and circumferentially arranged single parts which are able to be moved by suitable operation means, not illustrated, radially towards or away from said external surface of the hollow can body in order to support or release said can body at said closed end.

I claim:

1. An apparatus for edging a hollow can, said can having a longitudinal axis and a cylindrically-shaped body having an opposed pair of ends, at least one of said can ends having a respective edge to be worked, comprising:

a pair of adjustably movable operating heads for producing a plastic deformation of the respective can edge to be worked, each of said adjustably movable over the ends having a respective longitudinal axis which said head is independently movable along;

a cylindrically-shaped housing disposed between said operating heads for supporting and rotationally maintaining the can body along the longitudinal axis of the can, said housing having a pair of opposed ends, wherein each of said housing ends corresponds with a respective said operating head to define an operating zone therebetween;

a respective cylindrically-shaped pad for contacting against said can edge to be worked, each pad connected to a respective operating head and having an identical profile that is to be formed on the edges of the can body when worked, each pad and operating head pair having a respective longitudinal axis that is oblique to said longitudinal axis of said can and forms a respective angle therebetween, each respective angle having a first and second component wherein said first component corresponds to a vertical deviation from said longitudinal axis of said can and said second component corresponds to a laterial deviation from said longitudinal axis of said can;

respective driving means integral with each operating head for simultaneously rotating and linearly moving said respective pad with respect to said axis of said operating head, each said means defining a first position in which the shaped pad is not in contact with the edge and a second position wherein the shaped pad is linearly moved into the operating zone and into contact against the edge to be shaped, said contact inducing rotation of the can body in the same direction of rotation of the shaped pad when in said second position, wherein said means gradually advances said pad linearly along said pad axis so as to maintain said angle after contact with said can edge, thereby plastically deforming said edge in an incremental fashion, preventing can edge punctiform deformation, each of said driving means independently terminating rotational movement of the pad following plastic deformation of the respective can edge.

2. The apparatus according to claim 1, wherein the shaped pad forms a same shape in the edge profile of the can, the can edge corresponding to a circumference of the can.

3. The apparatus according to claim 1, wherein the said angle between pad axis and the longitudinal axis of the can body is between 0 and 30°.

4. The apparatus according to claim 1, wherein the said angle between the pad axis and the longitudinal axis of the can body is between 0.5 and 5°.

5. The apparatus according to claim 1, wherein contact between the edge of the can body and the operating head is performed inside the can body.

6. The apparatus according to claim 1, wherein contact between the edge of the can body and the operating head is performed outside the can body.

7. The apparatus according to claim 1, wherein the respective angles are equal.

8. Equipment according to claim 1, wherein each of said shaped pads is set at a different angle to said longitudinal axis of the can body.

9. A method for edging a cylindrically shaped can body through plastic deformation of at least one of a pair of opposed edges of the can, said can body having a longitudinal axis, comprising the steps of:

providing at least one operating head with a shaped pad integrally attached therein, said operating head set at a relative distance away from at least one edge of the can, said operating head and pad having an identical longitudinal axis that forms an oblong angle with respect to said longitudinal axis of the can body, said angle comprised of a first and a second component, wherein said first component corresponds to a vertical deviation from said longitudinal axis of said can and said second component corresponds to a lateral deviation from said longitudinal axis of said can;

holding the can body longitudinally within a housing that will allow rotation of the can therein;

linearly moving the shaped pad along the longitudinal axis of said operating head towards said can body while simultaneously rotating said pad along said same axis and then contacting the pad against the can edge gradually advancing said pad to incrementally shape the edge thereof so that punctiform deformation of the can edge is non-existant.

10. The method for edging a can according to claim 9, further comprising the steps of:

providing a second operating head and shaped pad at another end of said can, said operating head and pad having an identical longitudinal axis that forms a second oblique angle with respect to the longitudinal axis of the can body;

simultaneously linearly and rotationally moving the second shaped pad along said longitudinal axis of said second operating head and contacting the second pad against the other can edge in order to deform and shape the other can edge.

* * * * *